US006609811B1

(12) United States Patent
Sharrah

(10) Patent No.: US 6,609,811 B1
(45) Date of Patent: Aug. 26, 2003

(54) HANDCUFF KEY LIGHT

(75) Inventor: Raymond L. Sharrah, Collegeville Borough, PA (US)

(73) Assignee: Streamlight, Inc., Eagleville, PA (US)

( * ) Notice: Subject to any disclaimer, the term of this patent is extended or adjusted under 35 U.S.C. 154(b) by 29 days.

(21) Appl. No.: 09/969,301

(22) Filed: Oct. 2, 2001

Related U.S. Application Data

(60) Provisional application No. 60/238,502, filed on Oct. 6, 2000.

(51) Int. Cl.[7] ..... F21V 33/00

(52) U.S. Cl. ..... 362/116; 362/201; 362/200; 362/800; 70/404

(58) Field of Search ..... 362/109, 116, 362/200, 201, 196, 197, 198, 119, 800; D8/347, 348; 70/395, 404, 408

(56) References Cited

U.S. PATENT DOCUMENTS

| | | | | |
|---|---|---|---|---|
| 1,408,526 | A | | 3/1922 | Lyhne |
| 1,955,511 | A | | 4/1934 | Muros |
| 2,208,498 | A | | 7/1940 | Cramer |
| 2,666,894 | A | | 1/1954 | Babernitsh |
| 3,863,062 | A | | 1/1975 | Caron |
| 4,085,315 | A | | 4/1978 | Wolter et al. |
| 4,276,582 | A | | 6/1981 | Burnett |
| 4,302,797 | A | | 11/1981 | Cooper |
| 4,392,186 | A | * | 7/1983 | Cziment ..... 362/116 |
| 4,408,261 | A | | 10/1983 | Polakoff |
| 4,433,365 | A | | 2/1984 | Rousseau |
| 4,521,833 | A | | 6/1985 | Wolter |
| D289,731 | S | | 5/1987 | Mennie |
| 4,692,846 | A | | 9/1987 | Johnson |
| 4,745,527 | A | | 5/1988 | Belverio, Jr. et al. |
| 4,831,504 | A | | 5/1989 | Nishizawa et al. |
| 4,864,474 | A | | 9/1989 | Maglica |
| 5,158,356 | A | | 10/1992 | Guthrie |
| 5,181,927 | A | | 1/1993 | Song |
| 5,303,131 | A | | 4/1994 | Wu |
| 5,386,351 | A | | 1/1995 | Tabor |
| 5,457,613 | A | | 10/1995 | Vandenbelt et al. |
| 5,460,022 | A | | 10/1995 | Parsons |
| 5,515,249 | A | | 5/1996 | Shiao |
| 5,541,817 | A | * | 7/1996 | Hung ..... 362/116 |
| D373,469 | S | | 9/1996 | Hamilton |
| 5,568,741 | A | | 10/1996 | Parsons |
| D375,372 | S | | 11/1996 | Allen |

(List continued on next page.)

OTHER PUBLICATIONS

Ralph Mroz, "Do Handcuffs Matter?", http://www.sw–psdw.com/psdw/news/00–9_handcuffs.htm, Sep. 2000, 2 Pages.

James L. Underwood, "NIJ Standard For Metallic Handcuffs", http://www.blacksteel.com/NIJ_Standard–0307.01.html, Mar. 1982, 9–Pages.

Galls, "State Seal Cuff Key From ASP", http://www-.galls.com/shop/viewProductionDetail.jsp?item=RS063, 2001, 1–Page.

Galls, "Galls Round–Handle Swivel Cuff Key", http://www.galls.com/shop/view ProductionDetail.jsp?item=RS052, 2001, 2–Pages.

*Primary Examiner*—Sandra O'Shea
*Assistant Examiner*—Ali Alavi
(74) *Attorney, Agent, or Firm*—Dann, Dorfman, Herrell & Skillman, P.C.

(57) ABSTRACT

A handcuff key light illuminates the keyhole of a handcuff. The handcuff key light includes a cylindrical handcuff operating member which is molded into a body including at least one light source for providing light along the cylindrical handcuff operating member. The lightsource is selectively connected to an electrical power source to provide electrical power to the light source to illuminate toward the handcuff operating member.

41 Claims, 11 Drawing Sheets

U.S. PATENT DOCUMENTS

| | | | | | |
|---|---|---|---|---|---|
| 5,638,713 | A | * | 6/1997 | Roth et al. | 70/404 |
| 5,704,236 | A | | 1/1998 | Parsons | |
| D390,090 | S | | 2/1998 | Tobin, Jr. | |
| 5,713,656 | A | | 2/1998 | Lin | |
| 5,730,013 | A | | 3/1998 | Huang | |
| D393,407 | S | * | 4/1998 | Parsons | D8/347 |
| 5,772,308 | A | | 6/1998 | Lin | |
| 5,826,969 | A | | 10/1998 | Nevin | |
| 5,845,986 | A | | 12/1998 | Breen | |
| 5,882,106 | A | | 3/1999 | Galli | |
| D408,712 | S | | 4/1999 | Parsons | |
| 5,893,631 | A | | 4/1999 | Padden | |
| 5,937,680 | A | | 8/1999 | Parsons | |
| 6,109,073 | A | | 8/2000 | Parsons | |
| 6,132,058 | A | * | 10/2000 | Kuo | 362/116 |
| 6,244,722 | B1 | * | 6/2001 | Seebock | 362/116 |
| 6,280,046 | B1 | * | 8/2001 | Perez | 362/116 |
| 6,523,973 | B2 | | 2/2003 | Galli | |
| 6,530,672 | B2 | | 3/2003 | Galli | |
| 2003/0072151 | A1 | | 4/2003 | Galli | |
| 2003/0076674 | A1 | | 4/2003 | Galli | |

* cited by examiner

HANDCUFF KEY LIGHT

This Application claims the benefit of U.S. Provisional Application 60/238,502 filed on Oct. 6, 2000.

The present invention relates to a key light, in general, and, in particular, to a handcuff key light.

Law enforcement officers are often required to perform their duties under adverse conditions and in dimly lit areas. One specific task they must perform is the placing and removing of handcuffs on a difficult and struggling suspect.

Due to the fact that a suspect may be struggling in a dimly lit area, it can be quite difficult for the officer to see where the keyhole is on the handcuffs. Furthermore, powerful officers will not be able to restrict the amount of force that may be required while removing the handcuffs, thereby subjecting the handcuff keys to enormous amounts of stress during turning. As a result, a way is needed to project a light generally along the key shaft, to illuminate the handcuff key hole. Also, it is desirable to have a handcuff key that is strong enough to withstand the forces that it will be subjected to during turning under harsh physical conditions.

To this end, the present invention comprises a handcuff key light, having a cylindrical handcuff operating member comprised of either a key or a double locking pin, having one or more stabilizing protrusions extending generally radially from the cylindrical key, which is molded into a body. Additionally, there is a light source for providing light along the cylindrical handcuff operating member, and connected to an electrical power source to provide electrical power to the light source.

BRIEF DESCRIPTION OF THE DRAWING

The detailed description of the preferred embodiments of the present invention will be more easily and better understood when read in conjunction with the Figures of the Drawing which include.

Figure 1:
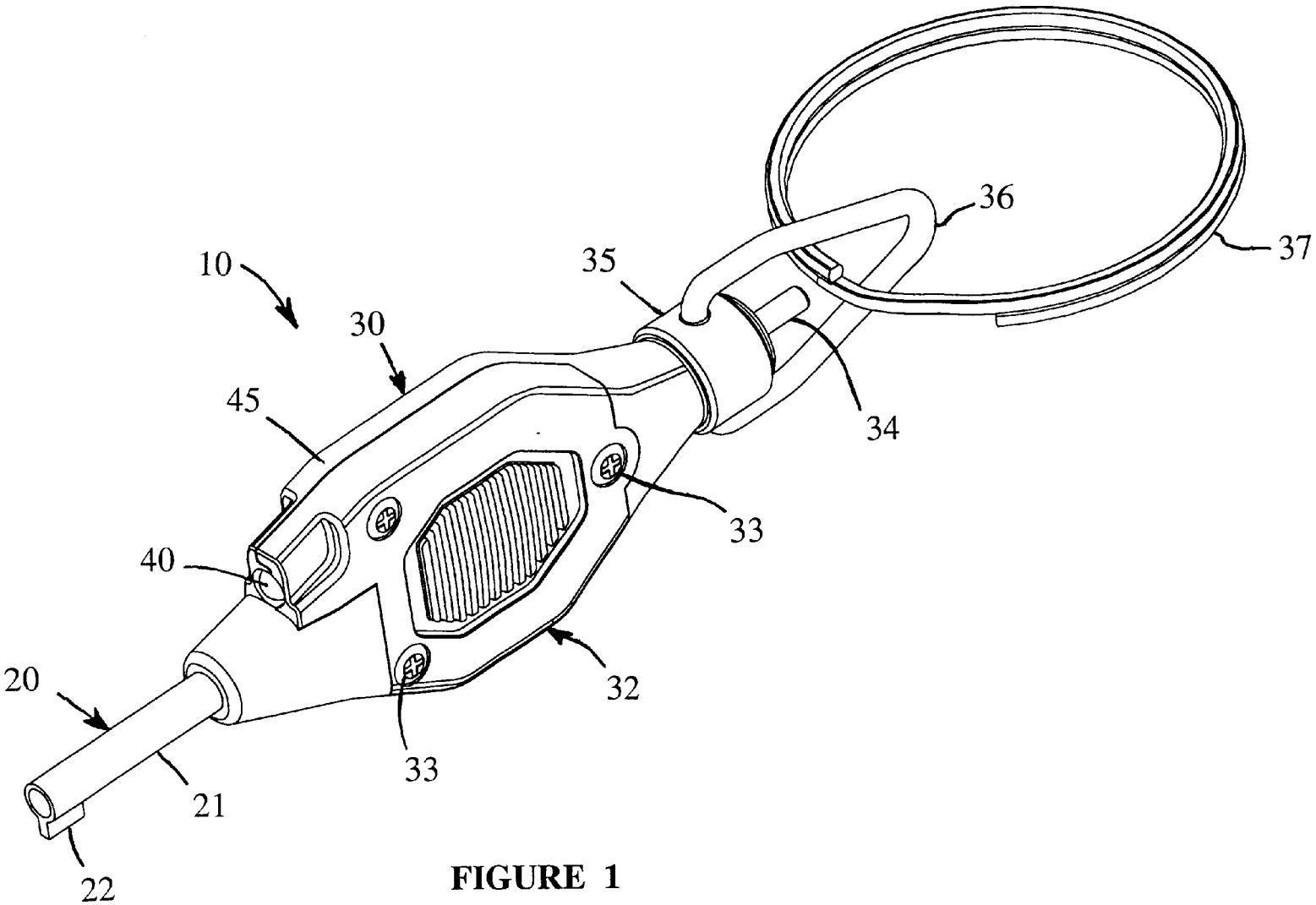
FIG. 1 is an isometric view schematic diagram of a handcuff key light according to the present invention.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. It is noted that, according to common practice, the various features of the drawing are not to scale, and the dimensions of the various features are arbitrarily expanded or reduced for clarity.

DESCRIPTION OF THE PREFERRED EMBODIMENTS

Figure 2:
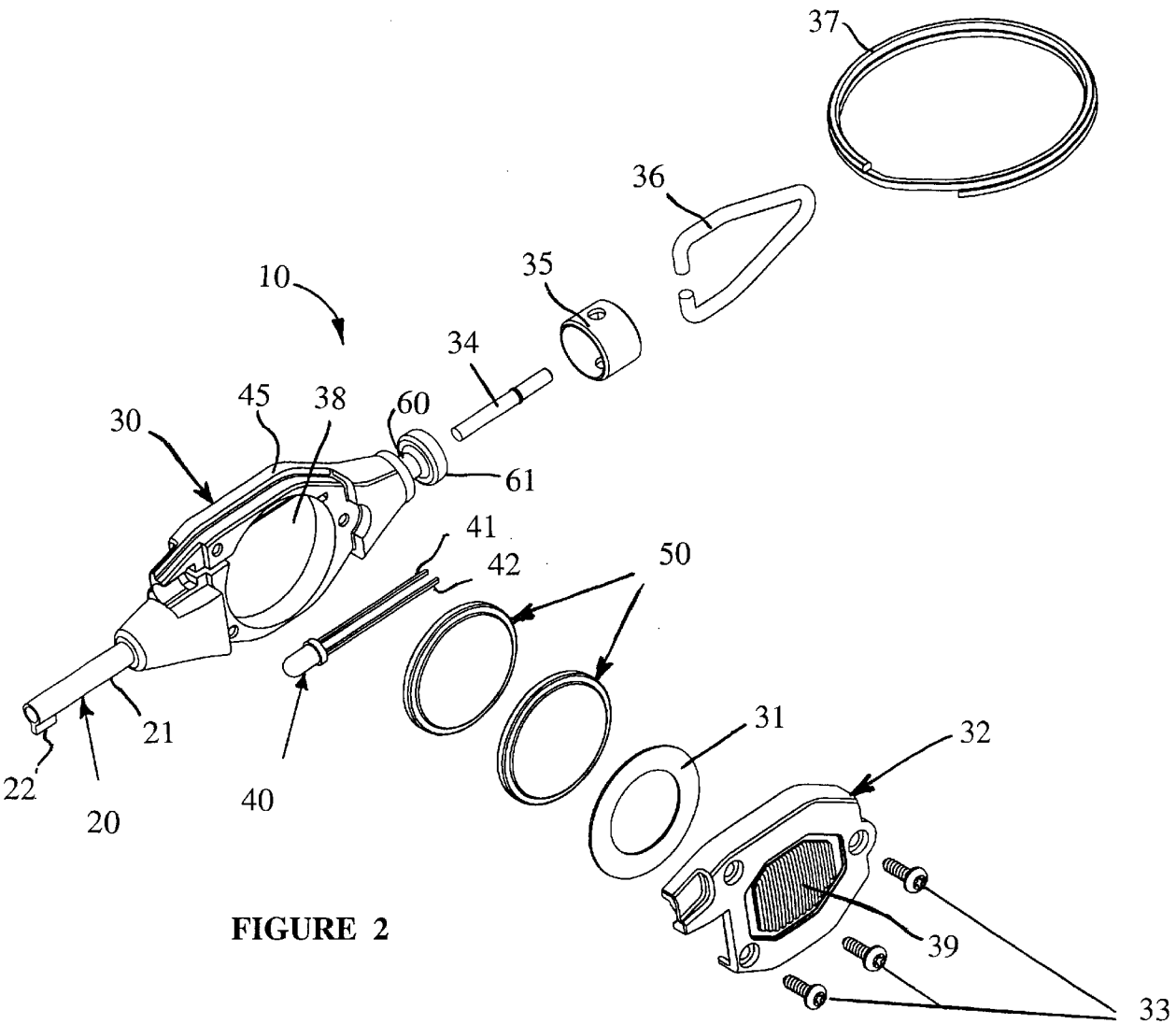
FIG. 2 is an exploded isometric view schematic diagram of the handcuff key light of FIG. 1.

FIG. 1 is an isometric view schematic diagram of a handcuff key light according to the present invention. FIG. 2 is an exploded isometric view schematic diagram of the handcuff key light of FIG. 1. Handcuff key light 10 comprises a cylindrical handcuff operating member, which may be in the form of an operative cylindrical key 20, extending forward from a front end of molded body 30, for locking and/or unlocking a handcuff. Cylindrical key 20 is typically inserted into and rotated in a handcuff keyhole in order to release the handcuffs from a suspect's hands. As may be convenient, another cylindrical handcuff operating member in the form of a locking pin 34 is provided at the rearward end of molded body 30. In addition, swivel collar 35, swivel loop 36, and ring 37 may also be provided at the rearward end of body 30 for carrying convenience.

Figure 3:
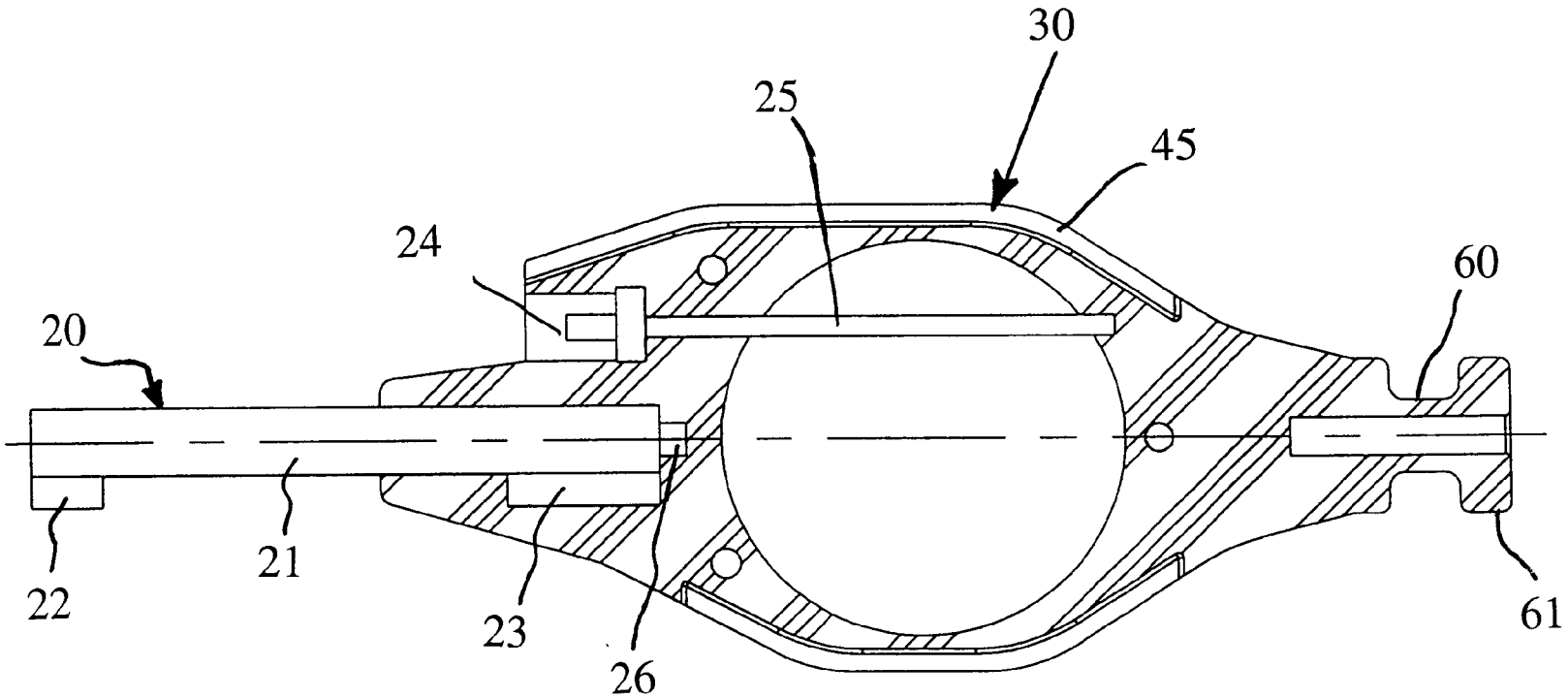
FIG. 3 is a partial side section elevation schematic diagram of the handcuff key light shown in FIGS. 1 and 2.

Molded body 30 is generally rectilinear, resembling a rectangular parallelpieped having a taper at the front end where cylindrical key 20 is molded into body 30, and a similar taper at the rearward end where pin 34 and collar 35 are disposed. Furthermore body 30 contains cavity 38, typically a cylindrical cavity, substantially centrally located in body 30, and typically encompassing the greater portion of the center of body 30, as may be seen in the partial side-section elevation schematic diagram of FIG. 3. Cylindrical cavity 38 in body 30 is adapted to receive at least one cylindrical battery 50.

Molded body 30 typically includes a base 45 and a cover 32 that are fastened together. A forward cavity 24 is provided at the front taper of body 30, typically in base 45, and is adapted to receive a light source, such as LED 40. LED 40 is disposed within body 30, with its light-producing end in cavity 24, such that a first lead 41 of LED 40 is substantially flush against the bottom of cavity 38, and is disposed along channel 25. The depth of channel 25 is less than the diameter or thickness of lead 41. When LED 40 is disposed in cavity 24, the light it produces is directed generally along the axial direction of cylindrical key 30.

At least one battery 50 is positioned in cavity 38 of body 30, typically in base 45, such that a first battery terminal of the battery is in constant electrical contact with first lead 41 of LED 40 at the bottom of cavity 38. An annular insulator such as insulating washer 31 is disposed against the second terminal of the battery, and separates the second lead 42 of LED 40 from the second terminal of battery 50, so that second lead 42 will not make contact with the second terminal of battery 50 until desired by the user of handcuff key light 10. The second lead 42 of LED 40 extends therefrom approximately parallel to lead 41, and is spaced away from lead 41, such that LED 40 is disposed with leads 41 and 42 straddling battery 50 and insulating washer 31. Lead 42 is flexed for selectively making electrical contact with battery 50 when actuating portion 39 of cover 32 is depressed.

Cover 32 is disposed over insulating washer 31, batteries 50, and LED 40, and is typically fastened to base 45 body 30 by means of screws 33. At least two screws 33, and preferably three screws 33 as in the illustrated embodiment, are employed to fasten cover 32 to body 30. Cover 32 is fastened to body 30 in a manner to provide sufficient stiffness to key 10, so that cover 32 will not separate from body 30 when exposed to high turning torque during rotation of handcuff key 10 in use. An arrangement with two screws at the forward end of body 30 (i.e. oppositely disposed on either side of key section 20), and one screw at the rearward end of body 30, situated approximately centrally to body 30 is satisfactory. However, any other means of fastening, besides screws, such as pins or rivets, chemical, heat or ultrasonic welding or adhesives, can also be utilized as may be convenient.

Figure 4:
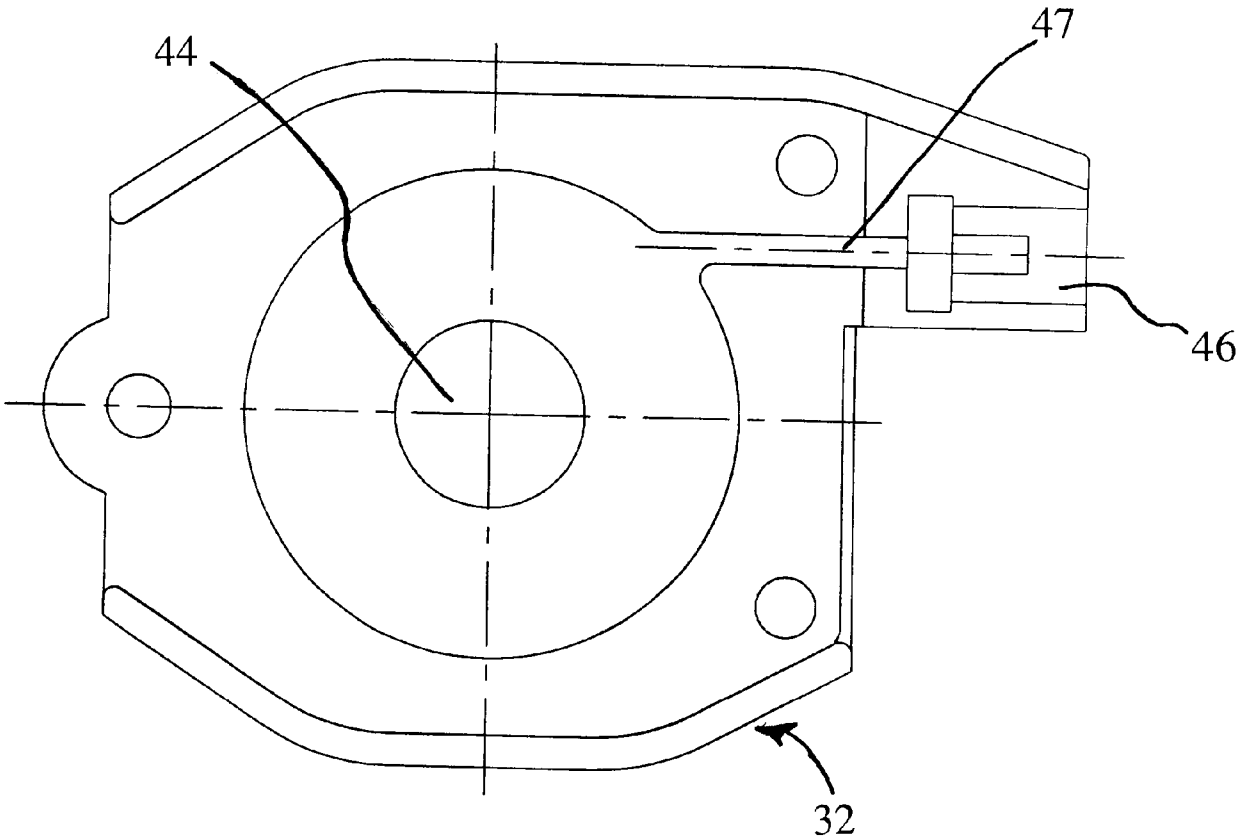
FIG. 4 is a side elevation schematic diagram of the cover shown in FIGS. 1 and 2.
Figure 5A:
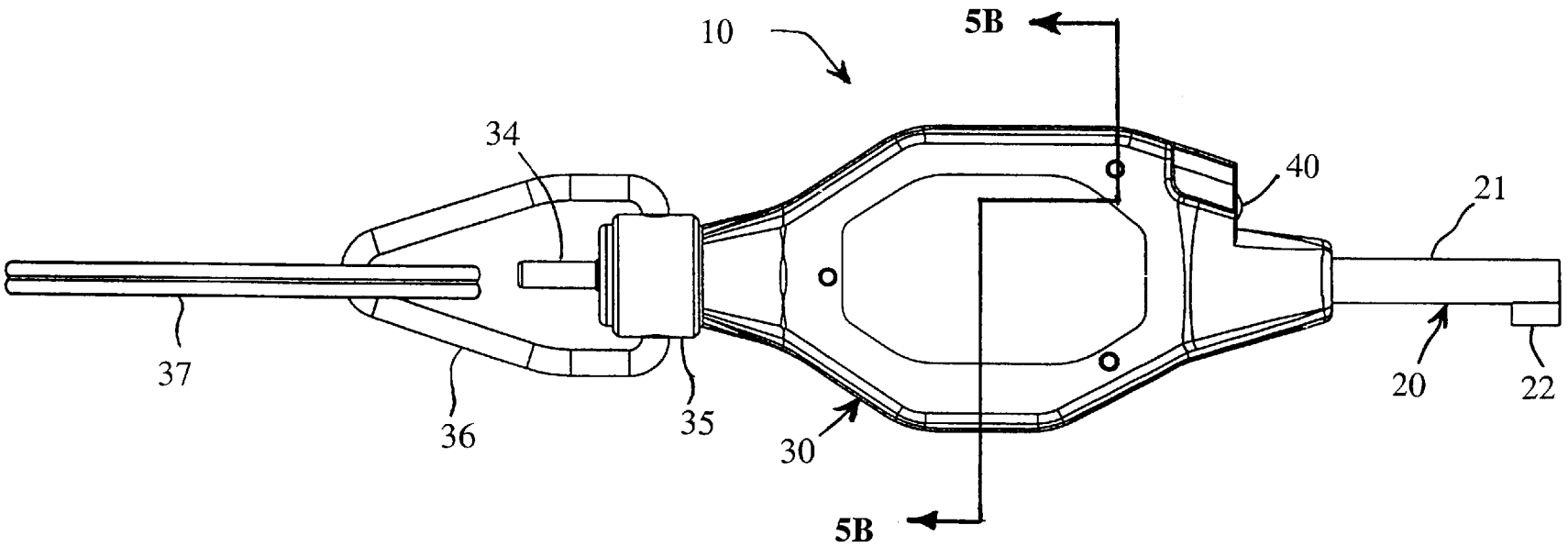
FIG. 5A is a side elevation schematic diagram of the handcuff key light shown in FIGS. 1 and 2.
Figure 5B:
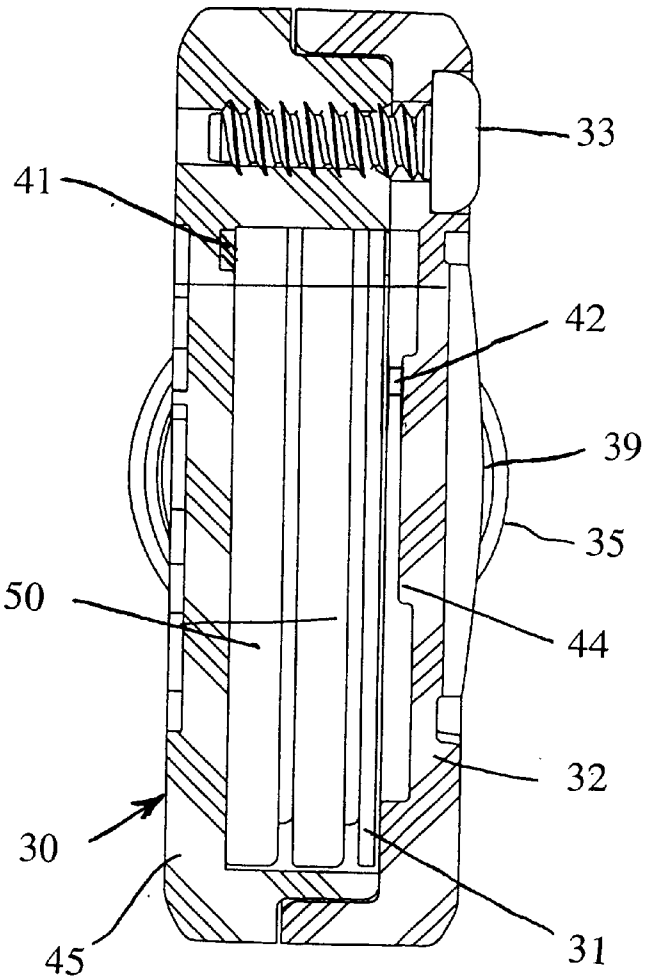
FIG. 5B is a cross-section schematic diagram of the handcuff key light shown in FIG. 5A, as viewed along line 5B—5B thereof.

Cover 32 includes a flexible actuating portion 39 in the central region thereof. Actuating portion 39 is formed thinner than the surrounding area of cover 32 in order to increase pliability in that region and reduce the amount of pressure required to depress actuating portion 39. Lead 42 is positioned such that it rests against the inside wall of cover 32, along channel 47, proximate to actuating portion 39, and, as shown in the side elevation schematic diagram of FIG. 4, spaced apart from battery 50 by insulating ring 31. Preferably, lead 42 is bent at an angle, for example, at about 45 degrees, and is disposed adjacent to raised feature 44 on the inside of the central region of cover 32. The height of raised feature 44 is less than the diameter or thickness of lead 42 so that when flexible actuating portion 39 is flexed to move toward battery 50, lead 42 makes contact with the terminal of battery 50.

Cylindrical key 20, which is generally cylindrical in shape, includes a metal shaft 21, some portion of which may be hollow, and a longitudinal lock flag 22 extending radially at the forward end thereof. Lock flag 22 is adapted for insertion into a handcuff keyhole for locking and/or unlocking the handcuff. Key 20 further includes one or more stabilizing protrusions, such as a longitudinal stabilizing flag 23, extending radially from the rearward end of metal shaft 21 to resist relative rotational movement of key 20 with respect to molded body 30. Other means of stabilization may be employed as well, for example, two or more stabilizing flags 23 extending radially from the rearward end of metal shaft 21, and spaced radially around the outside circumference of metal shaft 21.

At the rearward end of metal shaft 21 there exists a tip 26, which may provide further stability of key 20 as an alignment aid. It will be seen that tip 26 can also be formed in other ways, such as a recess within the metal shaft 21 of key 20, or a feature extending axially from the rearward end thereof. The rearward portion of metal shaft 21 and stabilizing flag 23 are molded into body 30 thereby to maintain the orientation of key 20 fixed with respect to key body 30, and prevent rotation of key 20 inside body 30 when subjected to rotational torque, e.g., due to the turning of handcuff key 10 inside of a handcuff lock. Key 20 is disposed at one end, usually referred to as the forward end, of body 30.

Cylindrical collar 35 is disposed annularly around pin 34 and annular flange 61 at the rear section of body 30 and has a hole through which pin 34 extends. Furthermore, collar 35 is held in place axially on body 30 by two prongs of swivel loop 36, extending radially inward into annular groove 60 through two opposing holes in collar 35 so as to engage annular flange 61, thereby, to secure loop 36 to body 30 in a manner that allows loop 36 and collar 35 to rotate, or swivel, about the longitudinal axis of body 30 of key 10, while remaining free to rotate about the axis of pin 34. Loop 36 can also be connected to an external key ring 37, such as a split ring key ring, for storage, transportation, and the like. Loop 36 is preferably formed triangularly, but any other suitable shape may be employed. As a result of the swivel action of collar 35, key 20 and body 30 may be rotated about their longitudinal axes in operation to lock or unlock a lock, such as a lock on a handcuff, without rotational restriction as a result of the swivel action of collar 35 and loop 36 with respect to body 30.

The cylindrical handcuff operating member may also be in the form of a pin 34. Pin 34 is disposed in the rear section of body section 30 and may be used, for example, engaging or disengaging the double-lock, or safety lock of a handcuff. Pin 34 is preferably molded into the rearward end of molded body 30 and may extend therefrom substantially coaxially with key 20, but can be disposed elsewhere on body 30 as may be convenient.

Battery 50 can be one or more batteries, each containing one or more cells, connected in series. In a preferred embodiment of the invention, two (2) three-volt (3 V) lithium cell batteries 50 are placed one on top of the other in cavity 38, preferably with their respective positive terminals facing the bottom of cavity 38, with the positive terminal of the bottom battery 50 placed in constant physical contact with anode lead 41 of LED 40. Thus, two series-connected 3-volt batteries cooperate to provide a 6-volt battery. The negative terminal of the series-connected batteries 50 is positioned proximate cathode lead 42 of LED 40, but is normally separated or spaced apart therefrom by insulating ring 31. Furthermore, LED 40 and battery 50 cooperate, or operate in conjunction with each other, to provide illumination along the shaft of cylindrical key 20, allowing an officer to illuminate the keyhole on the handcuff, when leads 41 and 42 are selectively connected to battery 50.

When actuating portion 39 is depressed, the interior surface of actuating portion 39 flexes LED lead 42, so that LED lead 42 is selectively brought into contact with the second terminal of battery 50. Thus, a complete circuit is selectively formed between the second terminal of battery 50 and the first terminal of battery 50, thus applying the potential provided by battery 50 across LED 40, and causing LED 40 to illuminate in the directions of key 20 and pin 34.

In the illustrated embodiment of the invention, two 3-volt lithium batteries are shown in a series circuit configuration, producing a total source voltage of 6 V across LED 40. However, there can be other embodiments incorporating more than two, or less than two batteries 50, configured in series and connected to lead 41 and lead 42 of LED 40.

Referring now to FIGS. 6–10, an alternative embodiment of the handcuff key light according to the present invention is shown.

Figure 6:
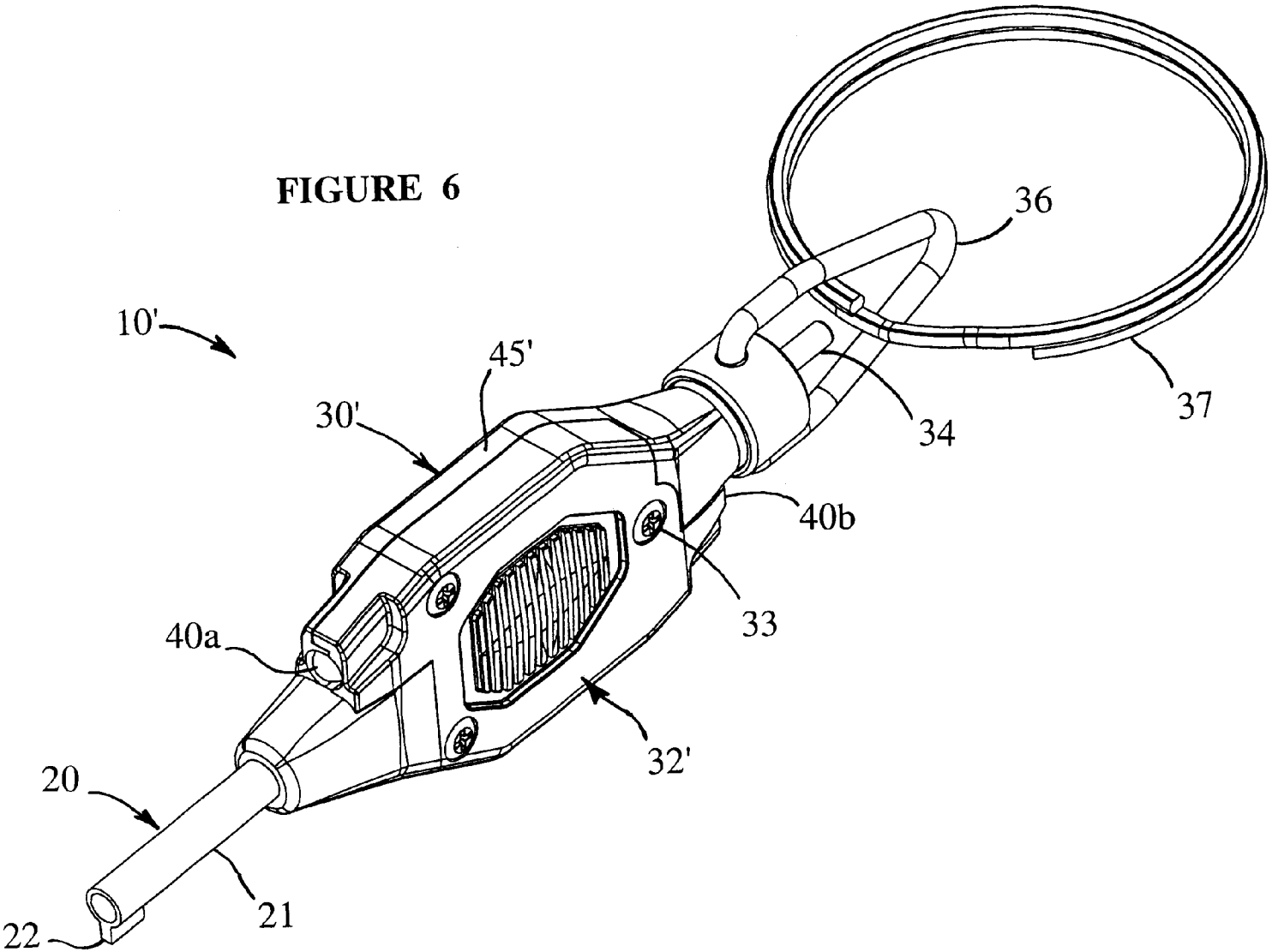
FIG. 6 is an isometric view schematic diagram of an alternative embodiment of the handcuff key light according to the present invention.
Figure 7:
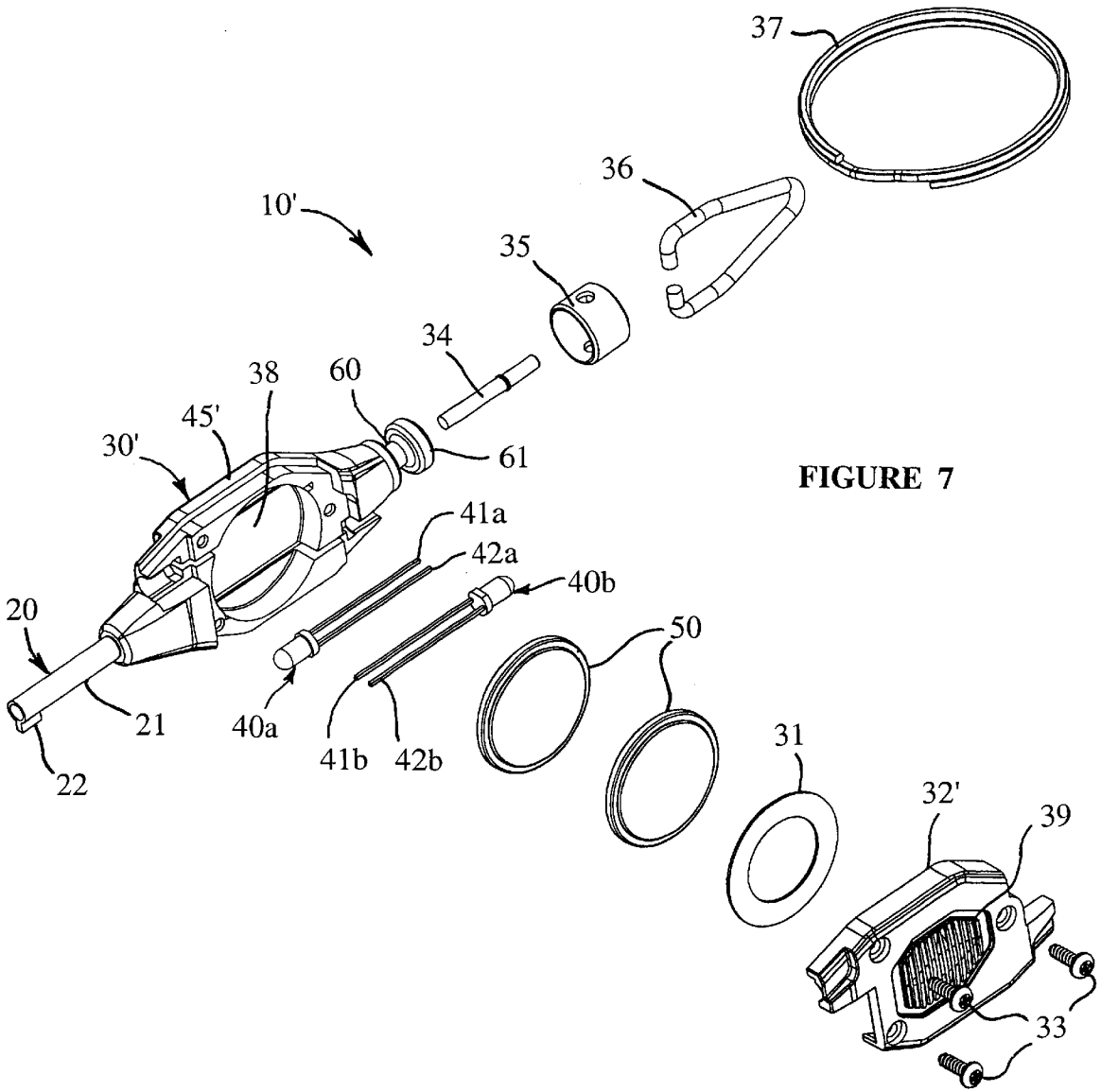
FIG. 7 is an exploded isometric view schematic diagram of the alternative embodiment of the handcuff key light of FIG. 6.
Figure 8:
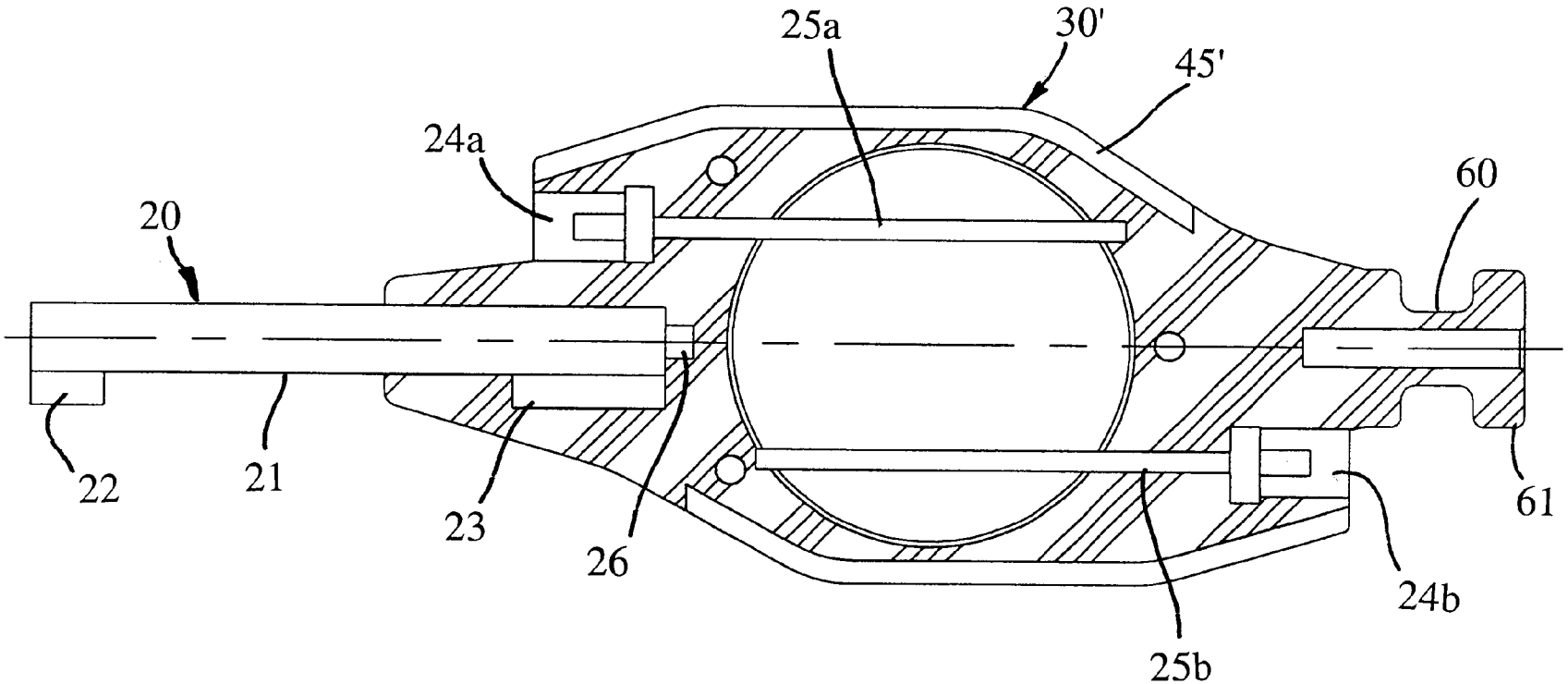
FIG. 8 is a partial side section elevation schematic diagram of the alternative embodiment of the handcuff key light shown in FIGS. 6 and 7.
Figure 9:
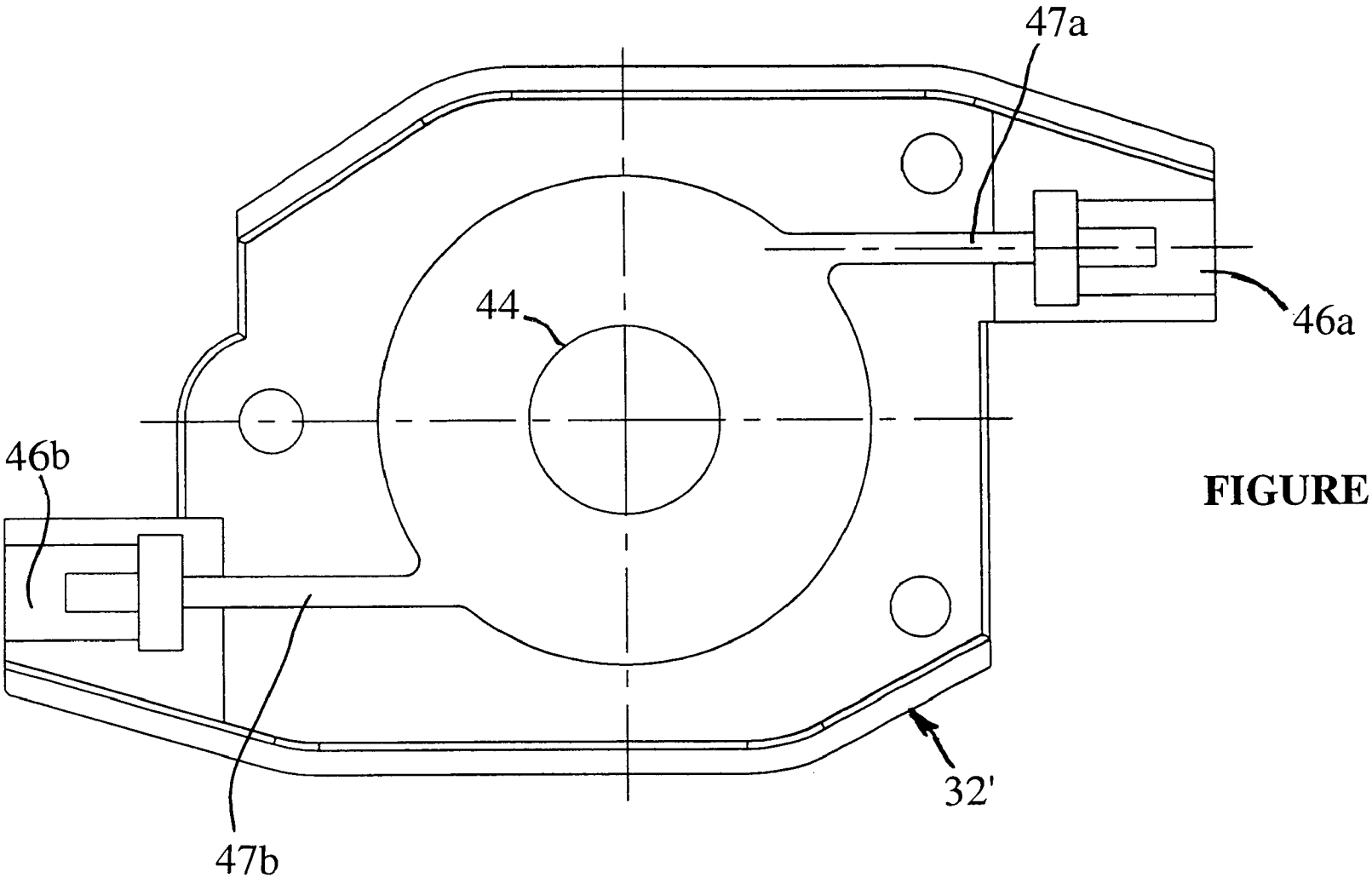
FIG. 9 is a side elevation schematic diagram of the cover shown in FIGS. 6 and 7.
Figure 10:
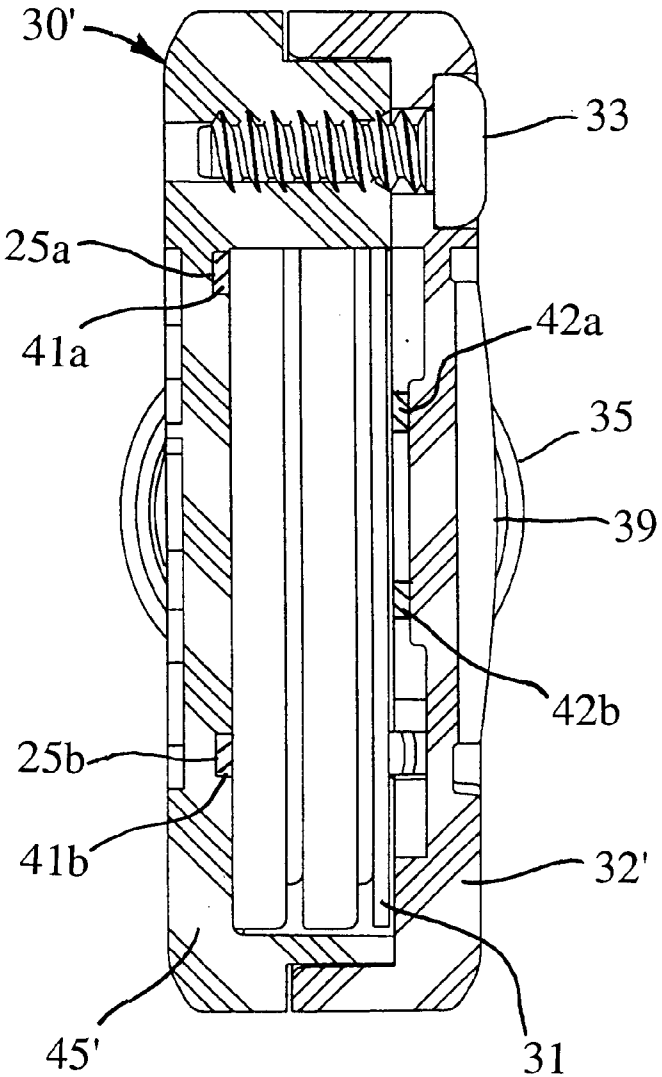
FIG. 10 is a partial cross-section schematic diagram of the alternative embodiment of the handcuff key light shown in FIG. 6.

FIG. 6 is an isometric view schematic diagram of a handcuff key light according to the present invention. FIG. 7 is an exploded isometric view schematic diagram of the handcuff key light of FIG. 6. Handcuff key light 10' comprises a cylindrical handcuff operating member, which may be in the form of an operative cylindrical key 20, extending forward from a front end of molded body 30', for locking and/or unlocking a handcuff. Cylindrical key 20 is typically inserted into and rotated in a handcuff keyhole in order to release the handcuffs from a suspect's hands. As may be convenient, another cylindrical handcuff operating member in the form of a locking pin 34 is provided at the rearward end of molded body 30'. In addition, swivel collar 35, swivel loop 36, and ring 37 may also be provided at the rearward end of body 30' for carrying convenience.

Molded body 30' is generally rectilinear, resembling a rectangular parallelpieped having a taper at the front end where cylindrical key 20 is molded into body 30', and a similar taper at the rearward end where pin 34 and collar 35 are disposed. Furthermore body 30' contains a cavity 38, typically a cylindrical cavity 38 substantially centrally located in body 30', and typically encompassing the greater portion of the center of body 30', as may be seen in the partial side-section elevation schematic diagram of FIG. 8. Cylindrical cavity 38 in body 30' is adapted to receive at least one cylindrical battery 50.

Molded body 30' typically includes a base 45' and a cover 32' that are fastened together. A forward cavity 24*a* is provided at the front taper of molded body 30', typically in molded base 45', and is adapted to receive a light source, such as LED 40*a*. LED 40*a* is disposed within body 30', with its light-producing end in cavity 24*a*, such that a first lead 41*a* is substantially flush against the bottom of cavity 38, and is disposed along channel 25*a*. The depth of channel 25*a* is less than the diameter or thickness of lead 41*a*. When LED 40*a* is disposed in cavity 24, the light it produces is directed generally along the axial direction of cylindrical key 20.

A rearward cavity 24*b* is formed at the rear of molded body 30', typically in molded base 45', and is adapted to receive a light source, such as LED 40*b*. LED 40*b* is also disposed within body 30', with its light-producing end in cavity 24*b*, such that a first lead 41*b* of LED 40*b* is substantially flush against the bottom of cavity 38, and is disposed along channel 25*b*. The depth of channel 25*b* is also less than the diameter or thickness of lead 41*b*. When LED 40*b* is disposed in cavity 24*b*, the light it produces is directed generally along the axial direction of pin 34.

At least one battery 50 is positioned in cavity 38 of body 30', typically in base 45', such that a first battery terminal of the battery 50 is in constant electrical contact with first leads 41*a* and 41*b* of LEDs 40*a* and 40*b*, respectively, at the bottom of cavity 38. An annular insulator such as insulating washer 31 is disposed against the second terminal of the battery 50, and separates the second leads 42*a* and 42*b* of LEDs 40*a* and 40*b*, respectively, from the second terminal of battery 50, so that second leads 42*a* and 42*b* will not make contact with the second terminal of battery 50 until desired by the user of handcuff key light 10'. The second leads 42*a* and 42*b* of LEDs 40*a* and 40*b* extend therefrom approximately parallel to leads 41*a* and 41*b*, and are spaced away from leads 41*a* and 41*b*, such that LEDs 40*a* and 40*b* are disposed with leads 41*a* and 42*a*, and leads 41*b* and 42*b* straddle battery 50 and insulating washer 31. Leads 42*a* and 42*b* are flexed for selectively making electrical contact with battery 50 when actuating portion 39 of cover 32' is pressed.

Cover 32' is disposed over insulating washer 31, batteries 50, and LEDs 40*a* and 40*b*, and is fastened to base 45' of body 30' by means of screws 33. At least two screws 33, and preferably three screws 33 as in the illustrated embodiment, are employed to fasten cover 32' to body 30. Cover 32' is fastened to body 30' in a manner to provide sufficient stiffness to key 10', so that cover 32' will not separate from body 30' when exposed to high turning torque during rotation of handcuff key 10' in use.

An arrangement with two screws at the forward end of body 30' (i.e. oppositely disposed on either side of key section 20), and one screw at the rearward end of body 30', situated approximately centrally to body 30' is satisfactory. However, any other means of fastening, besides screws, such as pins or rivets, chemical, heat or ultrasonic welding or adhesives, can also be utilized as may be convenient.

Cover 32' includes a flexible actuating portion 39 in the central region thereof. Actuating portion 39 is formed thinner than the surrounding area of cover 32' in order to increase pliability in that region and reduce the amount of pressure required to depress actuating portion 39. Leads 42*a* and 42*b* are positioned such that they rest against the inside wall of cover 32', along channels 47*a* and 47*b*, respectively, proximate to actuating portion 39, and, as shown in the side elevation schematic diagram of FIG. 9, spaced apart from battery 50 by insulating ring 31. Preferably, leads 42*a* and 42*b* are bent at an angle, for example, at about 45 degrees, and are disposed adjacent to raised feature 44 on the inside of the central region of cover 32'. The height of raised feature 44 is less than the diameter or thickness of leads 42*a* and 42*b* so that when flexible actuating portion 39 is flexed to move toward battery 50, leads 42*a* and 42*b* make contact with the terminal of battery 50.

Cylindrical key 20, which is generally cylindrical in shape, includes a metal shaft 21, some portion of which may be hollow, and a longitudinal lock flag 22 extending radially at the forward end thereof. Lock flag 22 is adapted for insertion into a handcuff keyhole for locking and unlocking the handcuff. Key 20 further includes one or more stabilizing protrusions, such as a longitudinal stabilizing flag 23, extending radially from the rearward end of metal shaft 21 to resist relative rotational movement of key 20 with respect to molded body 30'. Other means of stabilization may be employed as well, for example, two or more stabilizing flags 23 extending radially from the rearward end of metal shaft 21, and spaced radially around the outside circumference of metal shaft 21.

At the rearward end of metal shaft 21 there exists a tip 26, which may provide further stability of key 20 as an alignment aid. Tip 26 can also be formed in other ways, such as a recess within the metal shaft 21 of key 20, or a feature extending axially from the rearward end thereof. The rearward portion of metal shaft 21 and stabilizing flag 23 are molded into body 30' thereby to maintain the orientation of key 20 fixed with respect to key body 30', and prevent rotation of key 20 inside body 30' when subjected to rotational torque, e.g., due to the turning of handcuff key 10' inside of a handcuff lock. Key 20 is disposed at one end, usually referred to as the forward end, of body 30'.

Cylindrical collar 35 is disposed annularly around pin 34 and annular flange 61 at the rear section of body 30' and has a hole through which pin 34 extends. Furthermore, collar 35 is held in place axially on body 30' by two prongs of swivel loop 36, extending radially inward into annular groove 60 through two opposing holes in collar 35 so as to engage annular flange 61, thereby, to secure loop 36 to body 30' in a manner that allows loop 36 and collar 35 to rotate, or swivel, about the longitudinal axis of body 30' of key 10', while remaining free to rotate about the axis of pin 34.

Loop 36 can also be connected to an external key ring 37, such as a split ring key ring, for storage, transportation, and the like. Loop 36 is preferably formed triangularly, but any other suitable shape may be employed. As a result of the swivel action of collar 35, key 20 and body 30' may be rotated about their longitudinal axes in operation to lock or unlock a lock, such as a lock on a handcuff, without rotational restriction as a result of the swivel action of collar 35 and loop 36 with respect to body 30'.

Pin 34 is a cylindrical handcuff operating member disposed in the rear section of body section 30' and may be used for engaging or disengaging the double-lock, or safety lock of a handcuff. Pin 34 is preferably molded into the rearward end of molded body 30', but can be disposed elsewhere on body 30' as may be convenient.

Battery 50 can be one or more batteries, each containing one or more cells, connected in series. In a preferred embodiment of the invention, two (2) three-volt (3 V) lithium cell batteries 50 are placed one on top of the other in cavity 38, preferably with their respective positive terminals facing the bottom of cavity 38, with the positive terminal of the bottom battery 50 placed in constant physical contact with the respective anode leads 41*a* and 41*b* of LEDs 40*a* and 40*b*. Thus, two series connected 3-volt batteries cooperate to provide a 6-volt battery. The negative terminal of the series-connected batteries 50 is positioned proximate cathode leads 42*a* and 42*b* of LEDs 40*a* and 40*b*, but is normally separated or spaced apart therefrom by insulating ring 31, so that leads 42*a* and 42*b* when flexed selectively connect to battery 50. Furthermore, LED 40*a* and battery 50 cooperate, or operate in conjunction with each other, to provide illumination in a direction along the shaft of cylindrical key 20, allowing an officer to illuminate the keyhole on the handcuff, when leads 41*a* and 41*b*, and 42*a* and 42*b* are selectively connected to battery 50. Likewise, LED 40*b* and battery 50 cooperate, or operate in conjunction with each other, to provide illumination in a direction along the shaft of pin 34.

When actuating portion 39 is depressed, the interior surface of actuating portion 39 flexes LED leads 42*a* and 42*b*, so that LED leads 42*a* and 42*b* are selectively brought into contact with the second terminal of battery 50. Thus, a complete circuit is selectively formed between the second terminal of battery 50 and the first terminal of battery 50, thus applying the potential provided by battery 50 across LEDs 40*a* and 40*b*, and causing LEDs 40*a* and 40*b* to illuminate in the directions of key 20 and pin 34.

In the illustrated embodiment of the invention, two 3-volt lithium batteries are shown in a series circuit configuration, producing a total source voltage of 6 V across LEDs 40 and 40'. However, there can be other embodiments incorporating more than two, or less than two batteries 50, configured in series and connected to leads 41*a* and 41*b*, and leads 42*a* and 42*b* of LEDs 40*a* and 40*b*, respectively.

Molded body 30, 30' and cover 32, 32' are formed of a plastic material having a modulus of flexibility in a range such that the cover and body will not break during the high turning stresses they may be subjected to by a powerful police officer, but that is rigid enough so that the cover and/or body will not easily distort and/or separate from each other during such use to a degree that the selective electrical connections of LED leads 41, 41*a*, 41*b*, 42, 42*a* and/or 42*b* with battery or batteries 50 is interrupted. Furthermore, it is desirable that both the cover and body be formed of the same material, e.g., for uniform appearance. One suitable material is an unreinforced super tough nylon.

Additionally, other materials can be utilized. Examples thereof include, for example, a super tough nylon 6/6, such as DuPont ZYTEL® nylon (polyamide), which has a modulus of flexibility of about $2.45\times10^5$ psi @25° C. and about $2.85\times10^5$ psi @−40° C. Furthermore, nylon is an injection moldable thermoplastic. Alternatively, DuPont ZYTEL® nylon 6/6, with a modulus of flexibility of about $3.2\times10^5$ psi @25° C., and with a 14% glass fiber filler for reinforcement may also be a suitable material. Likewise, thermoplastic elastomers such as urethane or santoprene #103-50 are suitable materials, but may be less desirable. G-33 glass filled nylon, which has a 33% glass filler, while sufficiently strong, may be too rigid to permit easy actuation of actuating portion 39 if portion 39 is relatively thick.

Suitable batteries include, for example, type CR2016 available from Energizer and similar button cells available from other battery suppliers. Suitable LEDs 40*a* and 40*b* include, for example, types NP-W available from Nichia Company, located in Japan. Cylindrical key 20 may be formed from an extruded blank from which portions of a longitudinal flange are removed to leave lock flag 26 and stabilizing flag 23, or flags 23 and 26 could be welded to a cylindrical blank. Suitable materials for key 20 and pin 34 include brass, steel, stainless steel and the like. Suitable handcuff keys 20 are standard items available from many commercial sources.

While the present invention has been described in terms of the foregoing exemplary embodiments, variations within the scope and spirit of the present invention as defined by the claims following will be apparent to those skilled in the art. For example, flex portion 39 could be in cover 32, 32' as illustrated, or as a flex portion of body 30, 30' providing the bottom or fundus of cavity 38, or both. Moreover, the designations "cover" and "body" are typically given to the thinner and thicker parts, respectively, that together provide a body within which are disposed one or more batteries 50 and one or more light sources 40. Rather than being provided as two pieces, such body could be a unit as obtained when a cover and body are fastened, e.g., by heat or ultrasonic welding or a solvent-type adhesive, or by a unitary molded body containing battery or batteries 50 and LEDs 40, or 40*a*, 40*b*.

While the exemplary light source described above is a LED, other types of light sources, such as an incandescent lamp, a xenon lamp, and the like, may be employed, and the light provided thereby, while generally in a direction along the operating member, need not be precisely aligned or focused, buy may provide general illumination. Moreover, while the exemplary battery type described above is a lithium cell, other types of batteries, such as alkaline batteries, silver batteries, and rechargeable batteries, among others, may be employed. In addition, cylindrical key 20 may be solid, hollow, or partially hollow.

LED 40, 40*a*, 40*b* may have at least one of its leads held spaced apart from battery 50 by an insulating member, such as washer 31, or a block or bar or rod of insulating material, or by the spacing of the leads 41, 42 or LED 40 being sufficiently greater than the thickness of battery 50 without an intervening insulating spacer.

What is claimed is:

1. A handcuff key light comprising:

a cylindrical key, said cylindrical key including at least one stabilizing protrusion extending generally radially from said cylindrical key;

a molded body, into which a portion of said cylindrical key including said at least one stabilizing protrusion is molded;

a light source, said light source disposed in said molded body to provide light in a direction along said cylindrical key; and an electrical power source, said electrical power source disposed in said molded body for providing electrical power to said light source.

2. The handcuff key light of claim 1, wherein said at least one stabilizing protrusion includes a stabilizing flag extending radially from a rearward end of said cylindrical key.

3. The handcuff key light of claim 1, wherein said electrical power source includes at least one battery, said at least one battery having first and second terminals selectively connected in circuit with said light source to selectively provide electrical power from said at least one battery to said light source.

4. The handcuff key light of claim 3, wherein said light source includes a light emitting diode, said light emitting diode having first and second leads, wherein one of said first and second leads of said light emitting diode is flexible for selectively making contact with one of said first and second terminals of said at least one battery.

5. The handcuff key light of claim 4, further comprising means for spacing said flexible lead of said light emitting diode apart from said one of said first and second terminals of said at least one battery.

6. The handcuff key light of claim 5, wherein said means for spacing includes an insulating washer.

7. The handcuff key light of claim 1, wherein said light source is a light emitting diode.

8. The handcuff key light of claim 1, wherein said molded body has a cavity therein to receive at least one of said electric power source and said light source, wherein said at least one of said electric power source and said light source is disposed in the cavity.

9. The handcuff key light of claim 1, wherein a portion of said molded body is thinner than the rest of said molded body to allow said portion to flex.

10. The handcuff key light of claim 1, further comprising a pin having a first end molded into said molded body and having a second end adapted for locking/unlocking a handcuff.

11. The handcuff key light of claim 10, further comprising a second light source disposed in said molded body to provide light in a direction along said pin.

12. The handcuff key light of claim 11, wherein said second light source is a light emitting diode.

13. The handcuff key light of claim 1, further comprising:

an annular collar disposed on said molded body, a swivel loop engaging said annular collar and said molded body for movably attaching to said molded body, said annular collar being movable for allowing said swivel loop to rotate with respect to said molded body.

14. The handcuff key light of claim 1, wherein said cylindrical key includes one of a tip and recess, and said tip or recess is adapted to align said cylindrical key during molding into said molded body.

15. The handcuff key light of claim 1, wherein said molded body includes one of nylon, reinforced nylon, super tough nylon, unreinforced super tough nylon, injection-moldable super tough nylon, urethane, and santoprene.

16. A handcuff key light comprising:

a cylindrical key, said cylindrical key having at least one stabilizing protrusion extending generally radially from said cylindrical key;

a molded body, into which a portion of said cylindrical key including said at least one stabilizing protrusion is molded, said molded body including a base and a cover;

a light source, said light source disposed in said molded body to provide light along said cylindrical key; and an electrical power source, said electrical power source disposed in said molded body for providing electrical power to said light source.

17. The handcuff key light of claim 16, wherein said at least one stabilizing protrusion includes a stabilizing flag extending radially from a rearward end of said cylindrical key.

18. The handcuff key light of claim 16, wherein said electrical power source includes at least one battery having first and second terminals selectively connected in circuit with said light source to selectively provide electrical power from said at least one battery to said light source.

19. The handcuff key light of claim 16, wherein said light source includes a light emitting diode having first and second leads, wherein one of said first and second leads of said light emitting diode is flexible for selectively making contact with one of said first or second terminals of said at least one battery.

20. The handcuff key light of claim 19, further comprising means for spacing said flexible one of said first or second leads of said light emitting diode apart from said one of said first or second terminal of said at least one battery.

21. The handcuff key light of claim 20, wherein said means for spacing includes an insulating washer.

22. The handcuff key light of claim 16, wherein said light source includes a light emitting diode.

23. The handcuff key light of claim 16, wherein said base of said molded body has a cavity therein for receiving at least one of said electric power source and said light source, wherein said at least one of said electric power source and said light source is disposed in the cavity.

24. The handcuff key light of claim 16, further comprising a pin having a first end molded into said base of said molded body and having a second end for locking/unlocking a handcuff.

25. The handcuff key light of claim 24, further comprising a second light source disposed in said molded body to provide light along said pin.

26. The handcuff key light of claim 25, wherein said second light source is a light emitting diode.

27. The handcuff key light of claim 16, further comprising:

an annular collar rotatably mounted on said molded body, a swivel loop engaging said molded body through said annular collar, said annular collar thereby being rotatable for allowing said swivel loop to rotate with respect to said molded body.

28. The handcuff key light of claim 16, wherein said cylindrical key includes one of a tip and recess adapted to align said cylindrical key during molding into said molded body.

29. The handcuff key light of claim 16, wherein said molded body includes one of nylon, reinforced nylon, super tough nylon, unreinforced super tough nylon, injection-moldable super tough nylon, urethane, and santoprene.

30. The handcuff key light of claim 16, wherein said cover of said molded body is attached to said base of said molded body by at least one of screws, bolts, pins, rivets, chemical welding, heat welding, ultrasonic welding, and adhesive.

31. The handcuff key light of claim 16, wherein said cover of said molded body is attached to said base of said molded body by at least two screws.

32. The handcuff key light of claim 16, wherein a portion of said cover of said molded body is thinner than the rest of said molded body to allow said portion to flex.

33. A handcuff key light comprising:

a body having a first cavity for receiving a battery, said body having a second cavity generally parallel to a longitudinal direction of said body, said body including a base and a cover;

a cylindrical key molded into said body in the longitudinal direction, said cylindrical key including at least one stabilizing protrusion extending generally radially from said cylindrical key;

at least one battery disposed in said first cavity, said at least one battery having first and second terminals; and a light source disposed in the second cavity and having first and second leads extending into the first cavity, said first and second leads making contact with said first and second terminals of said at least one battery when at least one of said first and second leads is flexed.

34. The handcuff key light of claim 33, further comprising a pin having a first end molded into said body and having a second end adapted for locking/unlocking a handcuff.

35. The handcuff key light of claim 33, further comprising a swivel loop coupled to a rearward portion of said base of said body, said swivel loop being adapted for connection to an external key ring or hook, and said swivel loop being rotatable to allow said body and said cylindrical key to rotate with respect to said swivel loop.

36. A handcuff key light comprising:

a body, said body including a base and a cover, and having a first cavity for receiving a battery, having a second cavity generally parallel to a longitudinal direction of said body, and having an annular flange in a rearward portion of said base of said body;

a cylindrical key molded into said body in the longitudinal direction, said cylindrical key including at least one stabilizing protrusion extending generally radially from said cylindrical key;

a cylindrical collar disposed annularly around said annular flange;

a swivel loop, having two prongs extending radially inward into said annular groove adapted to engage said cylindrical collar;

at least one battery disposed in the first cavity, said at least one battery having first and second terminals; and a light source disposed in the second cavity having first and second leads extending into the first cavity, said first and second leads making contact with said first and second terminals of said at least one battery when at least one of said first and second leads is flexed.

37. A handcuff key light comprising:

a body, said body including a base and a cover, and having a first cavity for receiving a battery, having a second cavity generally parallel to a longitudinal direction of said body, and having an annular flange in a rearward portion of said base of said body;

a cylindrical handcuff operating member molded into said body in the longitudinal direction;

a cylindrical collar disposed annularly around said annular flange;

a swivel loop, having two prongs extending radially inward into said annular groove adapted to engage said cylindrical collar;

at least one battery disposed in the first cavity, said at least one battery having first and second terminals; and a light source disposed in the second cavity having first and second leads extending into the first cavity, said first and second leads making contact with said first and second terminals of said at least one battery when at least one of said first and second leads is flexed.

38. The handcuff key light of claim 37, wherein said cylindrical handcuff operating member is a cylindrical key molded into said body in the longitudinal direction, said cylindrical key including at least one stabilizing protrusion extending generally radially from said cylindrical key.

39. The handcuff key light of claim 37, wherein said cylindrical handcuff operating member is a pin having a first end molded into said body and having a second end for locking/unlocking a handcuff.

40. A handcuff key light comprising:

a body, said body including a base and a cover, and having a front end and rearward end, and having a first cavity for receiving a battery, having a second cavity generally parallel to a longitudinal direction of said body and having an opening at said front end, having a third cavity generally parallel to a longitudinal direction of said body and having an opening at said rearward end, and having an annular flange in a rearward portion of said base of said body;

a cylindrical key molded into said body in the longitudinal direction, said cylindrical key including at least one stabilizing protrusion extending generally radially from said cylindrical key;

a cylindrical collar disposed annularly around said annular flange;

a swivel loop, having two prongs extending radially inward into said annular groove adapted to engage said cylindrical collar;

at least one battery disposed in the first cavity, said at least one battery having first and second terminals;

a first light source disposed in the second cavity having first and second leads extending into the first cavity, said first and second leads making contact with said first and second terminals of said at least one battery when at least one of said first and second leads is flexed; and a second light source disposed in the third cavity having first and second leads extending into the first cavity, said first and second leads making contact with said first and second terminals of said at least one battery when at least one of said first and second leads is flexed.

41. A handcuff key comprising:

a molded insulating body including first and second handcuff operating members molded therein and extending from said body in first and second respective directions, said molded insulating body further including first and second sources of light disposed for illuminating in said first and second directions, whereby light from said first and second sources of light illuminates along said first and second handcuff operating members, said molded insulating body further including a battery disposed therein, each of said first and second sources of light including at least one electrical conductor extending proximate said battery, wherein said molded insulating body has a flexible portion for selectively causing electrical connection to be made between the at least one electrical conductor of each of said first and second sources of light and said battery, whereby said first and second sources of light selectively produce light when said flexible portion is flexed.

* * * * *